United States Patent [19]

Weatherly

[11] 4,299,334

[45] Nov. 10, 1981

[54] ANTI-THEFT DELIVERY MODULE

[75] Inventor: Douglas B. Weatherly, Conway, Ark.

[73] Assignee: Polyvend Inc., Conway, Ark.

[21] Appl. No.: 68,217

[22] Filed: Aug. 20, 1979

[51] Int. Cl.[3] ..... G07F 11/36

[52] U.S. Cl. ..... 221/1; 194/97 R; 221/12; 221/195

[58] Field of Search ..... 221/21, 75, 193, 194, 221/195, 196, 1, 12; 194/97 R

[56] References Cited

U.S. PATENT DOCUMENTS 2,057,880 10/1936 Collison et al. ..... 221/21

3,901,366 8/1975 Schuller ..... 221/12 X

*Primary Examiner*—F. J. Bartuska

*Attorney, Agent, or Firm*—Hill, Van Santen, Steadman, Chiara & Simpson

[57] ABSTRACT

An anti-theft delivery module which may be installed in new or existing vending machines blocks access to the product vending modules and collects products improperly removed from those modules. The collected products are stored in a closed storage area at the start of each legitimate vending cycle.

19 Claims, 7 Drawing Figures

ANTI-THEFT DELIVERY MODULE

BACKGROUND OF THE INVENTION

1. Field of the Invention

The invention pertains to anti-theft devices particularly for use in vending machines.

2. The Prior Art

In some locations vending machine owners and operators experience continual and chronic problems with vandalism and theft from the machines. It has become standard practice to have a guard door which is linked to the product access door such that when a purchaser pushes or pulls or rotates the product access door open, the guard door automatically closes thereby blocking any access to the supply of unvended products. However, even with such an arrangement there had been problems with theft from such machines wherein the machines are toppled forward or sideways, causing products to be dropped from the product delivery modules, passed the open guard door mechanism and into the product access area where they may be freely accessed and improperly removed. Since it is impossible at times to keep the machines from being overturned during an attempted theft, there has been a need for a mechanism which would collect the products improperly removed from the vending modules from an area where they might be accessed by the individuals attempting to steal them. There has also been a need for an improved anti-theft device which could, at a reasonable price, be retrofitted onto vending machines already on the field.

SUMMARY OF THE INVENTION

The invention comprises an improved method and apparatus to protect vending machines from theft. The apparatus is an anti-theft module installable into new or existing vending machines between the vending modules and the product delivery area.

The anti-theft module has a horizontally movable tray which carries a product collection chute having a slanted guard door. The normally closed guard door is positioned between the vending modules and the product delivery area.

Products which are improperly removed from the vending modules drop onto the normally closed, slanted, guard door and slide into the product collection chute under the influence of gravity. When a product has been paid for and properly selected, a motor retracts the tray carrying the guard door and chute horizontally. Any products which have been previously dropped onto the guard door fall from the chute into a closed storage area. While the guard door is retracted, the properly selected product is released from the selected vending module and permitted to drop past the retracted guard door and into the product delivery area. The tray carrying the guard door then is slid forward and mechanically locked closing off the lower product delivery area from the upper product vending moducles. A product access door may then be manually opened and the product removed from the product delivery area.

The improved method comprises the steps of:

collecting products improperly removed from the vending modules;

storing the collected products in a closed storage area; vending a validly selected product.

DETAILED DESCRIPTION OF THE PREFERRED EMBODIMENT

Not by way of limitation but by way of disclosing the best mode of practicing my invention and by way of enabling one of ordinary skill in the art to practice my invention, there is shown in FIGS. 1 through 7 one embodiment of my invention.

Figure 1:
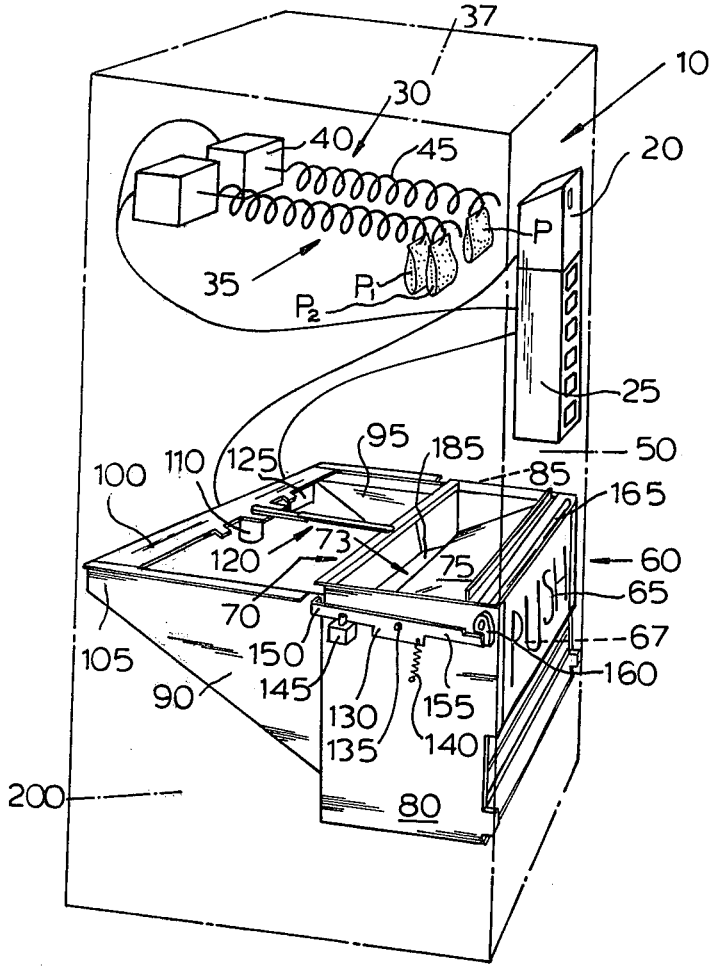
FIG. 1 is a perspective view of the inventive anti-theft module located within a vending machine.

A vending machine 10 is shown in FIG. 1 having a coin box 20 and a product selection apparatus 25. Both coin box 20 and the product selection apparatus 25 are conventional and well known in the art. Within the vending machine 10 are a plurality of vending modules such as modules 30,35. Each such vending module is internally supported by a housing 37 of the vending machine 10 and is controlled in a well known fashion through the coin box 20 and the selection apparatus 25. A vending module 30 normally has a vending motor such as a motor 40 connected to a vending apparatus such as a helical coil 45. As each of the coils such as the coil 45 makes one revolution under the control of the motor 40 a selected product, such as the product P at the end of the coil 45, is dropped from the vending module 30 into a lower region 50 of the vending machine 10. While the vending modules 30 and 35 are shown as having a helical coil for the purpose of dispensing the selected products such as the product P, it will be understood that my invention is applicable to all types of vending modules and the actual structure of the vending module is immaterial to my invention. All that is required that there be some controllable vending module or product dispensing mechanism which dispenses products one at a time and permits them to drop into the lower region 50 of the vending machine 10.

My invention, a modular anti-theft delivery compartment 60, is located in the lower region 50 of the vending machine 10. A purchaser having made a selection at the product selecting apparatus 25 views that product such as the product P being dropped off the vending module such as the module 30 into the lower part of the vending machine 50, and into my anti-theft delivery module 60. An inwardly pivoting front product access door 65 may subsequently be pushed in and opened by the purchaser who is then free to retrieve the delivered product P from a product delivery area 67 immediately behind the product access door 65. Additionally, my anti-theft delivery module 60 includes a horizontally slidable tray 70 which has a shaped product collection chute 73 with a slanted guard door panel 75 affixed thereto. The slanted guard door panel 75 is located essentially below the drop-off point of the vending module such as the modules 30 and 35, in the lower region 50 of the vending machine 10. In normal operation when a purchaser approaches the vending machine 10 the slanted guard door and the horizontally sliding tray mechanism 70 are located in their extreme forward position below the drop-off point of the product such as the product P from each of the vending modules such as the modules 30,35. In an extreme forward position the slanted guard door member 75 blocks access to the vending modules 30, 35 from the lower product delivery area 67. The anti-theft delivery module 60 has a supporting housing with a pair of elongated side members 80,85 which support a pair of rearwardly extending triangular brackets 90,95.

The rearwardly extending triangular shaped brackets 90, 95 each support a horizontal slide mechanism upon which the horizontally slidable tray 70 may be retracted from the extended or blocking position as shown in FIG. 1 wherein the slanted guard door 75 is interposed between the product such as the product P being dropped off the vending modules such as the modules 30,35 and the product access area 67 located immediately behind the product access door 65, to a more rearward position wherein the slanted guard door 75 is no longer interposed between the drop off point of the products such as the product P from each of the vending modules 30,35 and the product delivery area 57. An elongated bracket 100 attached at a rear end of each of the triangular brackets 90,95 such as the end 105 of the bracket 90 supports a drive motor 110 which is connected through a two-part linkage 120 to the horizontally sliding tray mechanism 70. When the output shaft of the motor 110 makes one revolution, the sliding tray mechanism 70 is first fully retracted from its forward, locked position, and then extended again into its forward locked position. Also supported by the elongated bracket 100 is an electronic control panel 125.

Pivotably supported on each of the elongated rectangular side members 80,85 is an elongated locking lever such as the lever 130 which pivots about a point 135 on the elongated side member 80. Each of the levers such as the lever 130, is spring biased by a biasing spring such as the spring 140 which has one end affixed to the panel 80. Each of the levers, such as the lever 130, has associated therewith an operating solenoid 145 which, under the control of the electronic control panel 125, can be actuated to pull downward a rear end 150 of the lever 130, causing the lever 130 to pivot about the point 135 thereby extending upwardly a front end 155 of the lever 130. When the front end 155 of the lever 130 is raised, under the influence of the solenoid 145, it engages a cam 160 affixed to an end of a rotary bar 165. The bar 165 is the pivot point for the product access door 65. Thus, when the solenoid 145 is energized and it raises the front end 155 of the lever arm 130, the front end 155 engages the cam 160 thereby blocking rotation of the bar 165 hence locking the product access door 65 closed. When the solenoid 145 is not activated the spring 140 retracts the front end 155 of the lever 130 thereby normally unlocking the product access door 65.

Also if the solenoid 145 is not energized the end 150 of the lever arm 130 is in its uppermost position. The end 150 has an inwardly extending tab which in that position is operative to lock mechanically the horizontally slidable tray mechanism 70. As a result in a quiescent state with solenoid 145 not energized the front product access door 65 is unlocked allowing access to the product delivery area 67 but the sliding tray mechanism 70 supporting the slanted guard door 75 is locked closed.

Our anti-theft delivery compartment 60 solves a problem that has been a very serious one for vending machine owners and operators. Very often, by various means, products such as the product P are improperly removed from the vending modules such as the vending modules 30,35 and are permitted to fall into the lower product delivery area 67 where they may be freely accessed, without purchasing them, and removed by unauthorized persons. One typical way that this is accomplished is by overtuning the vending machine thereby shaking the products such as the product P loose. When the machine is then righted, the products, under the influence of gravity, fall into the product delivery area 67 and are removable. When our anti-theft delivery module 60 is incorporated into the lower region 50 of a standard vending machine 10, attempts to dislodge the products such as the product P only result in those products dropping onto the slanted guard door 75 which as shown in FIG. 1 extend forward in the blocking position. The products slide down the door 75 into a lower region of the collection chute 73. The product collection chute 73 is defined in part by the slanted guard door panel 75 which moves with the horizontally slidable tray 70 and a fixed, elongated, rigid panel 185 which is attached to the elongated supporting panels 80,85 of the module 60.

When the module 60 is inserted into the lower region 50 of a standard vending machine 10 and when it is properly connected to the coin mechanism 20 and the product selection apparatus 25, as will be described subsequently, the module 60 operates as follows. Initially the horizontally slidable tray 70 is locked into its forwardmost position as shown in FIG. 1 with any products such as the product P which had been shaken loose from the vending modules 30,35 having slid downward on the slanted guard door 75 toward the fixed panel 185. In this condition the horizontally slidable tray mechanism 70 is mechanically locked shut by the level arms 130 and **130*a*. Thus, while a person attempting to in an unauthorized fashion remove products from the machine 10 might open the product access door 65, the slanted guard door 75 is locked shut thereby blocking any access to the upper portion of the vending machine 10 and in particular blocking access to the vending modules 30,35. Assuming, however, by overturning the machine 10 or some such action, products are shaken loose and drop onto the closed, slanted, guard door panel 75. When the person attempting to obtain those products then deposits coins in the coin box 20 and makes a valid product selection on the product selection apparatus 25, the electronic control panel 125 first energizes the solenoids 145,145*a* on each of the panels 80,85 which then pivot the locking levers 130,130*a* associated with each of the panels 80,85 thereby unlocking the horizontally slidable tray mechanism 70 and simultaneously locking the front product access door 65. The control circuitry 125 then energizes the motor 110, the output shaft of which makes one revolution. The linkage 120 in combination with the motor 110 horizontally retracts the slide mechanism 70 first rearward. As the slide mechanism 70 moves rearward horizontally the slanted guard door panel 75 attached thereto also moves rearward but the fixed elongated panel 185 does not so move. Thus, the product collection chute 73 of the horizontally sliding tray mechanism 70 no longer has a lower panel closing it off as did the panel 185 when the tray mechanism 70 was in its original position. Due to the fact that the product collection chute 73 of the horizontally slidable tray 70 is now open on the bottom, all of the products collected by the slanted guard door 75 now drop through the open space in the bottom of the chute 73 and into a closed storage area 200 at the rear of the vending machine 10 and behind the anti-theft module 60. The storage area 200 is readily closed off by sheet metal panels so that the products delivered thereto by the backward motion of the horizontally sliding tray 70** may in no way be accessed by the party attempting to seal them.

As the horizontally slidable tray 70 is being retracted to its rearmost position, by the output shaft of the motor 110 making one-half of a revolution, the selected vending module such as the module 30 or 35, is cycled permitting the selected product such as the product P to drop into the lower region 50 of the vending machine 10. Since the horizontally slidable tray mechanism 70 is being fully retracted, the slanted guard door member 75 is no longer interposed between the drop off point from the vending modules 30, 35 and the product delivery area 67. The product P then falls past the front edge of the slanted guard door panel 75 into the product access area 67. Subsequently the output shaft of the motor 110 makes a second one-half revolution extending the horizontally slidable tray mechanism 70 forward again into its blocking position with the slanted guard door panel 75 again located between the vending modules 30, 35 and the product delivery area 67. The locking levers **130, 130*a* associated with the panels 80,85 return to their quiescent condition mechanically locking the horizontally slidable tray 70 closed and unlocking the product access door 65. The single purchased product P, located now in the product delivery area 67**, may be accessed by the purchaser.

Figure 2:
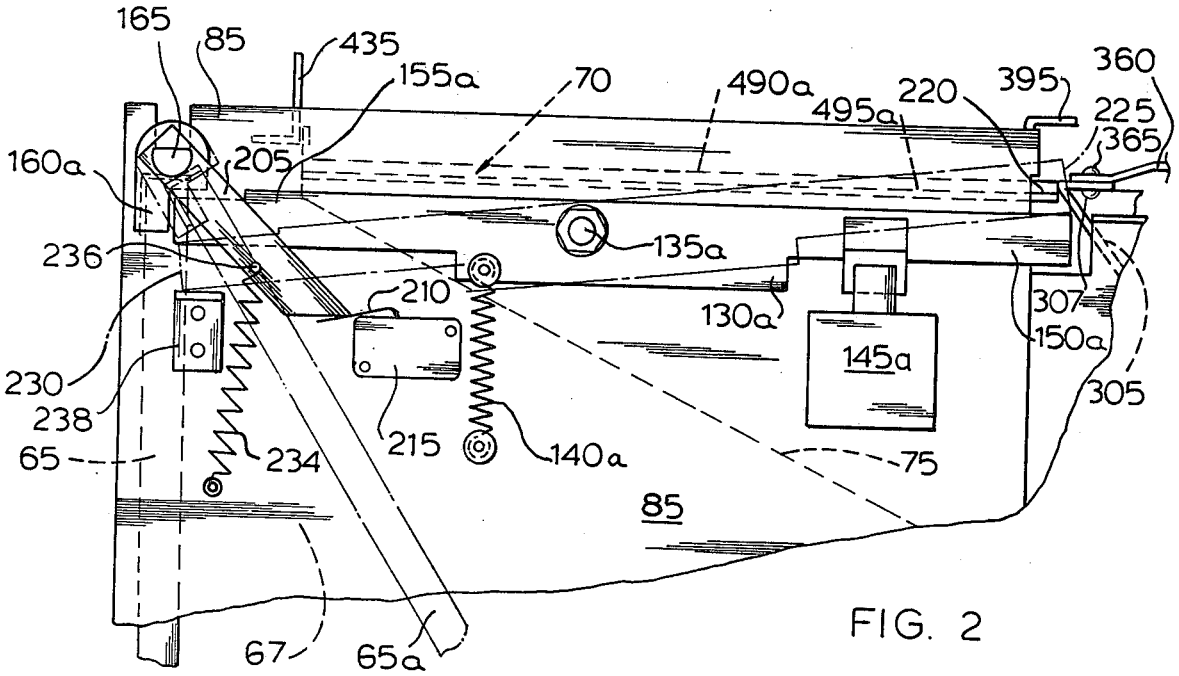
FIG. 2 is a partial, enlarged, side elevation of the anti-theft vending module of FIG. 1.

FIG. 2 is a partial side elevation view of the elongated supporting panel 85. Each of the elements on the panel 85 corresponding to a previously discussed element on the panel 80 is indicated on the panel 85 having the same identification number as was used to define it on the panel 85 followed by a lower case "a". Thus, on the panel 85 there is shown in FIG. 2 a locking lever **130*a* which pivots about a pivot point 135*a* in response to a biasing spring 140*a* and an actuating solenoid 145*a*. An elongated cam member 160*a* which is affixed to an end of the rotary pivot bar 165 engages a front end 155*a* of the locking lever 130*a*. In FIG. 2 the quiescent state of the locking lever 130*a* is shown in phantom and the active state with the solenoid 145*a* energized shown in solid lines. Also shown in FIG. 2 is an open or pivoted position 65*a* of the product access door 65. When the product access door 65 has been rotated to its normally open position, 65*a*, a lever arm 205 attached to the end of the pivoting rod 165 moves away from an atuating arm 210 of the switch 215. Thus, the switch 215 becomes an open circuit in response to the product access door 65 having been moved from a closed to an open position 65*a*. Shown in phantom in FIG. 2 is a portion of the horizontally sliding tray 70 along with the slanted guard door panel 75. A rear edge 220 of the horizontally slidable tray mechanism 70 is also shown in FIG. 2 adjacent an inwardly extending tab 225 which is affixed to the end 150*a* of the lever arm 130*a*. As can be seen from FIG. 2 when the spring 140*a* pulls the lever arm 130*a* into its quiescent position with the rear end 150*a* of the lever arm 130*a* in its uppermost position, the tab 225 is moved behind and adjacent to the surface 220 thereby locking mechanically any rearward motion of the horizontally movable tray mechanism 70. Additionally, as can be seen from FIG. 2, when the solenoid 145*a* is energized and moves the lever arm 130*a* downward hence moving the front end 150*a* of the lever arm 130*a* upward a front surface 230 of the lever arm 130*a* moves behind the cam member 160*a*, thereby blocking rotation of that cam member and locking the product access door 65 into its closed position. A spring 234 connected between the panel 85 and a point 236 on the lever arm 205 biases the door 65 normally closed. A stop 238 on the panel 85 limits downward motion of the front end 230 of the lever arm 130*a***.

Figure 3:
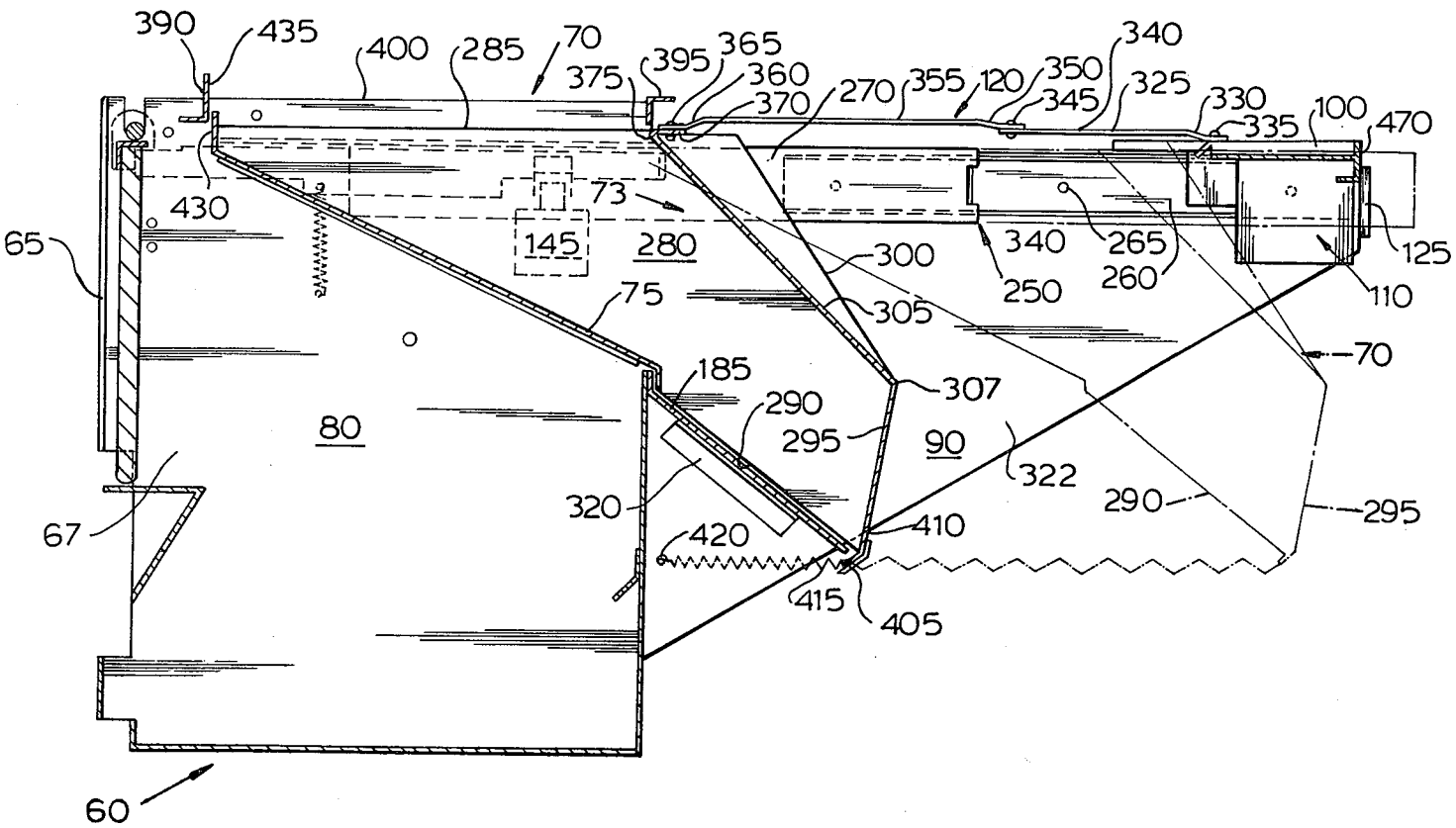
FIG. 3 is a sectional side view of the anti-theft delivery module of FIG. 1 with the open position of the sliding tray indicated in phantom.

FIG. 3 is a section view taken looking toward the elongated supporting panel 80 from a viewing point adjacent the elongated supporting panel 85. FIG. 3 shows the horizontally slidable tray mechanism 70 in its normally closed blocking position in solid lines and shows that mechanism 70 in its retracted position in phantom. A two-part slide 250, oriented for horizontal sliding motion has a fixed section 260 which is attached by means of a set of screws such as a screw 265 to the triangularly shaped supporting panel 90 and to the front elongated supporting panel 80. A second section 270 of the slide 250 slides horizontally on the first section 260. The horizontally sliding tray mechanism 70 has a side wall 280 which is bounded by a top horizontal surface 285, the slanted guard door panel 75, a lower edge 290 which is oriented at an angle with respect to the slanted guard door panel 75, a rear lower panel 295 and a rear edge 300. Additionally, the horizontally slidable tray 70 has an upper panel 305 which joins an upper edge 307 of the panel 295 and the upper surface 285. The product collection chute 73 into which the products tend to slide off of the slanted guard door panel 75 is bounded in part by the upper panel 305, the lower panel 295, the elongated fixed panel 185 which is attached by a right angle bracket 320 to an inside surface 322 of the triangularly shaped supporting flange 90.

Thus, as may be seen from the phantom view in FIG. 3 when the sliding horizontal tray 70 is retracted by the output shaft of the motor 110 making a one-half revolution, the product collection chute 73 no longer is closed by the fixed elongated panel 185 and as a result the products then are free to fall into the lower storage area 200 of the vending machine 10.

The two-part linkage 120 has a first elongated member 325 with a first end 330 pivotably attached at a pivot point 335 to the output shaft from the motor 110. A second end 340 of the linkage arm 325 is pivotably attached at a pivot point 345 to a first end 350 of a second lever arm 355 of the two-part linkage 120. A second end 360 of the linkage arm 355 is pivotably attached at a point 365 to a flange 370 which is affixed to a top edge 375 of the panel 305.

For purposes of improving the rigidity and strength of the module 60 a pair of right angle brackets 390,395 are affixed between the elongated support panels 80,85 near a top edge 400 of the panel 80. A connection bracket 405 is shown adjacent a lower end 410 of the panel 295. A retraction spring 415 is connected between the connection bracket 405 and a fixed point 420 of the triangularly shaped support panel 90. The anti-theft module 60 has a pair of springs corresponding to the spring 415, one at each end of the horizontally slidable tray mechanism 70. The purpose of the springs such as the spring 415 is to retract the horizontally slidable tray member 70 into its forwardmost blocking position thereby interposing the slanted guard door 75 between the product access modules 30,35 and the product delivery region 67 if for some reason the motor 110 and two-part associated linkage 120 fail to properly return the sliding tray 70 to its forwardmost position. The forwardmost locking position of the horizontally sliding tray mechanism 70 is shown in FIG. 3 with a vertical front surface 430 of the slanted guard door 75 being located against a second vertical surface 435 associated with the frontmost right angle bracket 390.

Figures 4, 5, 6:
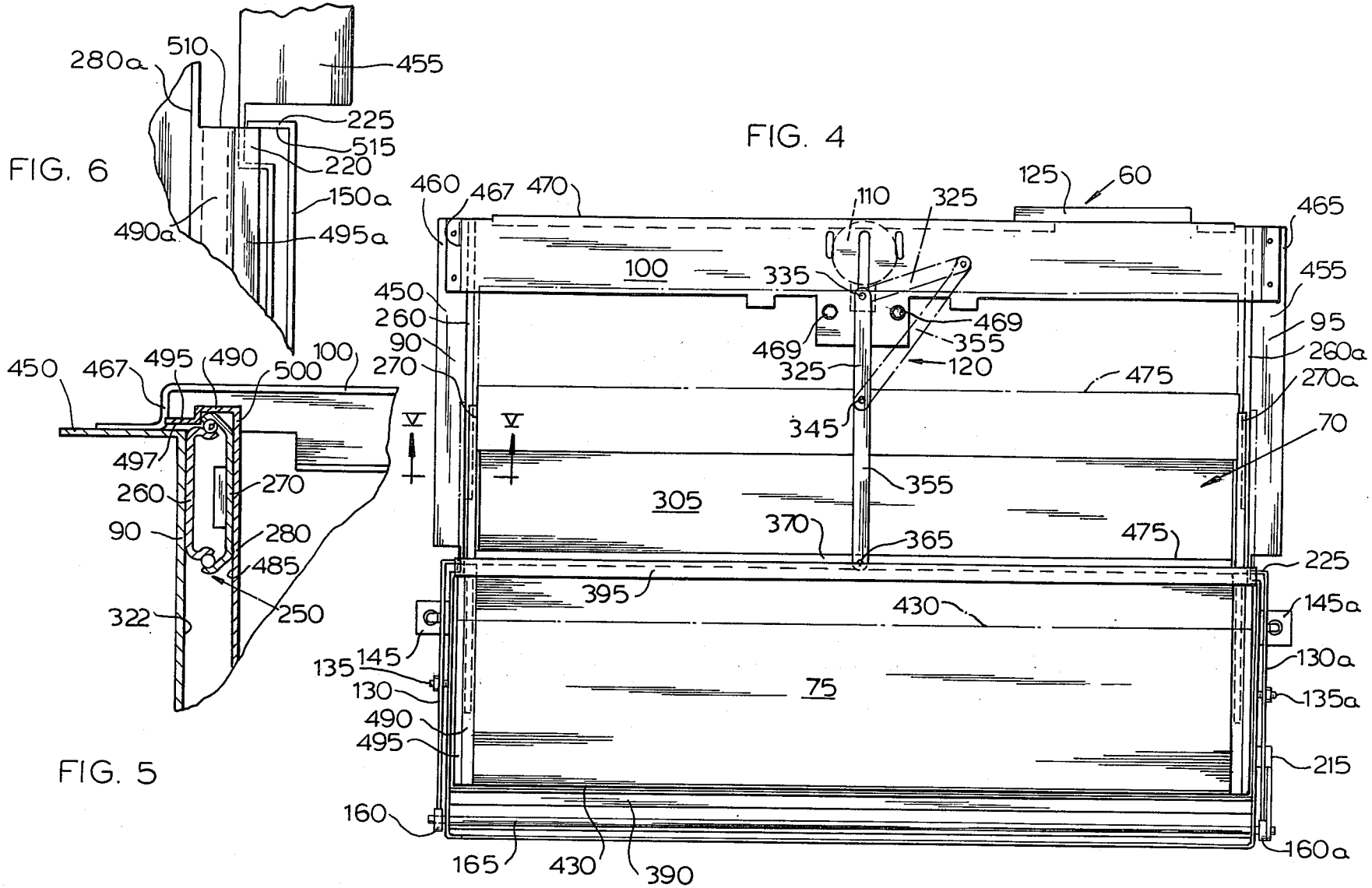
FIG. 4 is a top elevational view of the anti-theft delivery module of FIG. 1.
FIG. 5 is an enlarged partial sectional view taken along the line V—V of FIG. 4 showing the detail of the slide mechanism.
FIG. 6 is an enlarged partial top view with parts broken away showing the relationship of the sliding tray to the locking lever arms.

FIG. 4, a top planar view, shows the horizontally slidable tray assembly 70 in its closed and locked position in solid lines and shows it partially closed in phantom. Each of the triangular shaped supporting brackets 90,95 has a top flange 450,455. The elongated rear bracket 100 is affixed at a rear end 460,465 of the flange 450,455 respectively, by screws or welding or any other conventional means. The bracket 100 has a bend 467 at each end. The motor 110 is shown attached to the bracket 100 by screws 469. The shaft of the motor 110 extends through a hole in the bracket 100 and is pivotably attached at the pivot point 335 to the linkage 120. The electronic control package 125 is shown affixed to a rear surface 470 of the elongated supporting panel 100. FIG. 4 shows the two fixed rails **260,260*a* attached to the two triangular supporting panels 90,95. Additionally, the two sliding rails 270,270*a* are shown engaged with the fixed rails 260,260*a*. As can be seen from FIG. 4 as the two-part linkage 120 is caused to rotate by a clockwise rotation of the shaft of the motor 110 a rear edge 475 of the flange 370 adjacent the top end 375 of the panel 305 moves rearward and then forward from the position shown in phantom in FIG. 4 to the position shown by solid lines. Additionally, the vertical front surface 430 of the slanted guard door 75 is shown in FIG. 4 as having been retracted and then moved forward to the position indicated in phantom by the number 430 shown with a dashed lead line. The phantom position 430 as indicated in FIG. 4, represents a position of the vertical front surface of the slanting guard door 75 as the horizontally slidable tray assembly 70** is returning to its closed and locked position.

FIG. 5, a partial enlarged sectional view taken along line V—V of FIG. 4 discloses the details of the structure of the slide 250. The fixed portion 260 of the horizontal slide 250 is attached to the inside surface 322 of the triangularly shaped supporting bracket 90. The movable portion 270 of the slide 250 is attached to an outside surface 485 of the side plate 280 of the horizontally movable tray 70. The side plate 280 also has a two-part horizontally extending tab having parts 490,495 attached to an upper end 500. The horizontally extending tab portion 490 is located above the slidable member 270 of the slide mechanism 250 for support and positioning purposes. The exterior tab section 495 has a lower surface 497 which holds the lever arm 130 depressed when the tray assembly 70 is retracted from its forward blocking position if the solenoid 145 is no longer energized. As is conventional the two parts 260,270 of the slide 250 are carried on ball members.

FIG. 6, an enlarged partial top view has the bracket 395 broken away to show the relationship between the two-part horizontally extending flange member **490*a*,495*a* which is at the top of the side wall 280*a* of the horizontally movable tray 70 and the lever 130*a*. The side wall 280*a* corresponds to the side wall 280 but is at the opposite end of the horizontally slidable tray 70. To provide the mechanical locking required when the slidable tray 70 is in its forward, closed position, an end surface 510 which terminates the two-part horizontal flange 498,498*a* engages an interior surface 515 of the inwardly extending tab 225 affixed to the end 150*a* of the locking arm 130*a* when the solenoid 145*a* has not been energized. In this condition the tab 225 locks the side wall 280*a* hence also blocks the horizontally sliding tray mechanism 70 from moving horizontally rearwardly from its forward locked position. A corresponding tab is located on the locking lever 130**.

Figure 7:
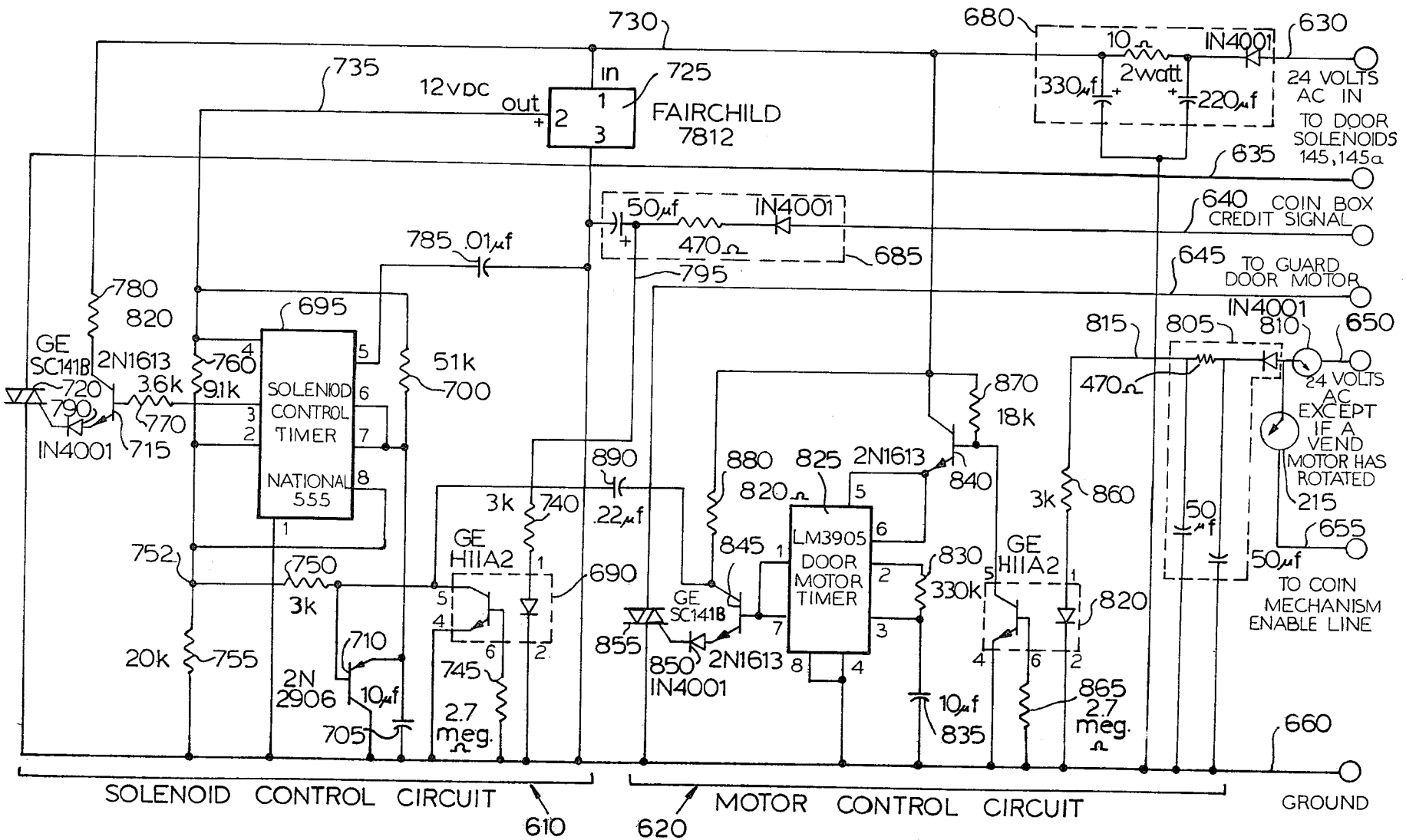
FIG. 7 is a schematic of the electronic control circuitry.

The schematic of FIG. 7 is divided generally into two parts. The left-most part 610 is a solenoid control circuit to control the solenoids **145,145*a* which are located on either side of the anti-theft vending module 60 for locking and unlocking the horizontally slidable guard door mechanism 70 and for unlocking and locking the front pivoting product access door 65. The right-most portion 620 is a motor control circuit for controlling the energization of the motor 110 which is mounted on the rear bracket 100 of the anti-theft module 60**.

With reference to a set of signals at the right-hand side of the schematic, a top-most signal line 630 is an input point for 24 volts AC. The next signal line down 635 is an input to each of the solenoids **145,145*a* for locking and unlocking the horizontally slidable tray mechanism 70. The second input to each of the solenoids is permanently connected to 24 volts AC. The third line 640 is a credit input signal from the coin box 20. It signals that appropriate credit has been detected on input coinage and in this condition has a 24 AC volt signal on it. Otherwise line 640 represents an open circuit. The next line 645 is an output line to one of the inputs to the guard door motor 110. The other input to the guard motor is permanently connected to 24 volts AC. The next line 650 is an input and normally has 24 volts AC on it except if one of the vending motors such as the motor 40 has been rotated either manually by hand or due to the receipt of electrical power. If any vending motor has been rotated, line 650 becomes open circuited. The next line 655 is an output line which provides a signal to the coin mechanism 20. A 24 volt AC signal on line 655 enables the coin mechanism 20 to accept coins. Otherwise, the coins are dropped through the coin mechanism 20 and into the coin return slot. The line 660 represents an electrical ground line. Thus, lines 630 through 640 are associated with the solenoid control circuit 610 and lines 645 through 655 are associated with the motor control circuit 620. The ground connection 660** is common to all lines.

Considering first the operation of the solenoid control circuit 610 which must operate to unlock the tray mechanism 70 and which also must operate to lock the product access door 65 before the motor control circuit 620 is permitted to cycle the drive motor 110, the solenoid control circuit 610 comprises a half-wave rectifier circuit 680 and a second half-wave rectifier circuit 685. The solenoid control circuit 610 also includes an optical isolator circuit 690 and a solenoid control timer 695. The solenoid control timer 695 has a timing resistor 700 and a timing capacitor 705. Across the timing capacitor 705 is a shorting transistor 710 whose purpose is to keep the capacitor 705 discharged until it is desired that the solenoid control timer 695 start its time interval. The solenoid control circuit 610 also includes a driver transistor 715 which provides gate drive to Triac 720. The Triac 720 when energized and permitted to conduct grounds the line 635 which is connected to the door solenoids 140,140*a* thereby applying 24 volts AC across the door solenoids which unlock the tray mechanism 70 and mechanically lock the front product access door 65. The solenoid control circuit 610 also includes a current regulator 725 which converts the unregulated DC output from half-wave rectifier 680, at about 40 volts DC when no current is being drawn, on line 730, to 12 volts DC regulated on an output line 735. Apart from the diodes, resistors and capacitors in the two half-wave rectifiers 680,685 the solenoid control circuit 610 includes additionally a set of resistors 740 through 780, a capacitor 785 and a threshold diode 790.

The half-wave rectifier 680 converts 24 volts AC input on line 630 to about 40 volts AC unregulated, with no current being drawn, on the line 730. The half-wave rectifier 685 converts 24 volts AC being applied, the coin box credit signal, on line 640 also to about 40 volts DC with no load on a line 795. The line 795 supplies the output from the half-wave rectifier 685 to a first terminal of current limiting resistor 740. A second terminal of current limiting resistor 740 is connected to pin 1, the anode of the diode input, of the optical isolator circuit 690. The cathode of the diode, on pin 2, is connected to ground line 660. The base of the transistor of the optical isolator 690 is connected to a first end of the resistor 745. A second end of the resistor 745 is connected to the ground line 660. An emitter connection, pin 4, of optical isolator 690 is also connected to the ground line 660. Capacitor 785 is connected between pin 5 of the timer 695 and the ground line 660 to insure proper operation of the timer 695.

The transistor 710 has an emitter connected to a first end of the ten microfarad capacitor 705, to a first end of the resistor 700 and to pin seven of the solenoid control timer 695. A collector of the transistor 710 is connected to the ground line 660. A base of the transistor 710 is connected to a first end of a resistor 750 and to the collector output, pin 5, of the optical isolator circuit 690. A second end of the resistor 750 is connected to a first end of the resistor 755, pin 8, and pin 2 of the solenoid control timer 695. A second end of the resistor 755 is connected to the ground line 660. An output pin 3 of the solenoid control timer 695 is connected to a first end of the resistor 770. A second end of the resistor 770 is connected to a base of the drive transistor 715. An emitter of the drive transistor 715 is connected to an anode of the threshold diode 790. A collector of the drive transistor 715 is connected to a first end of a resistor 780. A second end 780 is connected to the unregulated DC line 730. A cathode of the threshold diode 790 is connected to a gate input of the Triac 720. A second end of the resistor 700 is connected to the line 735, the 12 volt regulated DC output of the regulator 725, as well as pin 4 of the solenoid control timer 695 and a second end of the biasing resistor 760.

When adequate coinage is deposited in the coin box 20, a 24 volt AC coin box credit signal is generated by the coin box 20 and applied to the line 640. The 24 volt AC coin box credit signal input on the line 640 results in drive current being applied to the diode of the light emitting diode of the optical isolator 690. As a result the output line, pin 5, of the optical isolator 690 gives low and stays low throughout the entire time that the coin box credit signal is present.

Before the 24 volt AC signal is applied to the line 640, the voltage at the node 752 is about 8.2 volts, when pin 5 of optical isolator 690 goes low, that voltage at node 752 drops to about 2.6 volts. The voltage drop at the node 752 triggers the solenoid control timer 695 and its output on pin 3 goes high. A high output on pin 3 of the timer 695 causes the transistor 715 to conduct. The conducting transistor 715, through threshold diode 790, then triggers the Triac 720.

Because the output of the optical isolator 690, at pin 5, is low, the transistor 710, a pnp transistor, conducts continually since its base lead, also connected to pin 5 of the optical isolator 690 permits conduction to occur between its emitter which is connected through resistor 700 to line 735, which provides a regulated DC current, through the emitter-base junction of the transistor 710. So long as the transistor 710 continues to conduct, timing capacitor 705 will have essentially 0 volts across it. Once a product has been selected the coin box credit signal line 640 becomes an open circuit essentially coincidentally in time when one of the vending motors such as the motor 40 starts its vending cycle. When line 640 becomes open circuited, drive current through the resistor 740 to the light emitting diode of the optical isolator 690 ceases, thereby shutting off the optical transistor in the optical isolator and putting an open circuit on the output pin 5 thereof. At that time drive current supplied from the 12 volt DC regulator 725 through the voltage divider 760,755, applies a voltage through the resistor element 750 to turn off the transistor 710.

During the time the transistor 710 has been conducting, the output pin 3 of the timer 695 has been held high and the timer 695 has been inhibited from timing out as the timing capacitor 705 has been shorted. Once the coin box credit signal on the line 640 has been removed, the timer 695 carries out its timing function based on the values of capacitor 705 and resistor 700. The time out interval with the exemplary values of timing capacitor 705 and timing resistor 700 is nominally 3 seconds. Thus, the Triac 720 grounds the line 635 for the period between when coin box credit is established until about 3 seconds after any vend motor, such as the motor 40, starts to rotate. The solenoids 145, 145*a* thus unlock the tray 70 and lock the product access door 65 during this entire time interval.

Once the tray 70 starts its rearward horizontal motion, as can be seen in FIG. 5, the lower surface 497 of the outer flange 495 of the side wall 280 of the product collection chute 180 holds down the locking tab at the end 150 of the locking lever arm 130. Thus, until the product collection chute 180 returns to its forward, blocking position, the front product access door 65 is locked shut by the tray 70 depressing mechanically the locking lever arms 130, 130*a*.

The motor control circuit 620 operates essentially in parallel and simultaneously with the solenoid control circuit 610. The motor control circuit 620 has a half-wave rectifier 805 which converts 24 volts AC applied to line 650 to approximately 40 unregulated volts DC. The 24 volts AC on the line 650 is present at all times except when the motor of any vending module, such as the motor 40, has rotated. The voltage on line 650 is applied through a switch 810 which is mounted on the guard door motor 110 and which is closed when the output shaft of the guard door motor 110 is in its initial position. The motor control circuit 620 also includes an optical isolator 820 and a guard door motor timer 825. The timer 825, is set for approximately a seven to eight second time interval and is timed using a timing resistor 830 and a timing capacitor 835. The motor control circuit 620 also includes a pair of drive transistors 840 and 845, a threshold diode 850 and a Triac 855. When the Triac 855 conducts, it grounds one input to the guard door motor 110. Since the other input to guard motor 110 is always connected to 24 volts AC, the output shaft of the guard door motor 110 then rotates. The motor control circuit 620 also lincludes resistors 860 through 880.

A first terminal of the resistor 860 is connected to an unregulated DC output line 815. A second terminal of the resistor 860 is connected to a diode input, pin 1, of optical isolator circuit 820. Cathode output pin 2 and emitter output pin 4 of optical isolator 820 are both connected to the ground line 660. The base output pin 6 of optical isolator 820 is connected to a first terminal of the resistor 865. A second terminal of the resistor 865 is connected to the ground line 660. A collector output, pin 5, of the optical isolator 820 is connected to a first terminal of the resistor 870 and to base input of the transistor 840. A second terminal of the resistor 870 and a first terminal of the resistor 880 are each connected to the line 730, the unregulated DC output from the half-wave rectifier 680. A second terminal of the resistor 880 is connected to a collector of the transistor 845.

An emitter of the transistor 845 is connected to an anode of the diode 850. A cathode of the diode 850 is connected to a gate input of the Triac 855.

Normally, if none of the vending motors have been rotated and if the switch 810 corresponding to the switch on the guard motor 110, indicating the output shaft of the motor 110 has returned to its initial position is closed, the half-wave rectifier 805 applies unregulated, approximately 40 volts, DC to the line 815. The current through the resistor 860 drives the light omitting diode in the optical isolator 820 which in turn saturates the output, pin 5, of the transistor in the optical isolator 820. If the output of the optical isolator, pin 5, of 820 is essentially at ground, transistor 840, an emitter follower, is turned off as its base input is held essentially at ground. With transistor 840 turned off, the timer 825 is quiescent and will not generate a high voltage output signal on pin 7. As a result the drive transistor 845 will not cause the Triac 855 to conduct.

When a vending motor has been rotated, either by hand or on response to a product having been selected, the 24 volt AC input on line 650 is removed and line 650 becomes an open circuit. The output of the optical isolator 820, pin 5, then becomes an open circuit which in turn results in transistor 840 starting to conduct due to drive current being supplied through resistor 870 from line 730. When transistor 840 starts to conduct, its emitter connected to pins 5 and 6 of the timer 825 causes the timer circuit 825 to initiate a seven to eight second timing interval. During this seven to eight second time interval pin 7 of timer 825 goes high causing transistor 845 to conduct, applying voltage through the threshold diode 850 to the gate input of Triac 855. Triac 855 then starts to conduct applying essentially a ground signal to the output line 645. With the output line 645 grounded the guard motor 110 has 24 volts AC applied thereacross and it begins to rotate. As soon as the output shaft of the guard door motor 110 begins to rotate the switch 810 is opened blocking the application of the 24 volts AC on line 650 to the motor control circuit 620.

Assuming the vending machine 10 is operating properly, at some time during the one revolution of the output shaft of the guard door motor 110 the vending module motor, such as the motor 40, supplying the selected product has rotated and returned to its initial position. As a result, 24 volts AC is reapplied to the line 650. As soon as the output shaft of the guard door motor 110 returns to its initial position, the switch 810 is closed which again applies 24 volts AC to the half-wave rectifier 805 which generates the rectified, unregulated DC voltage on line 815 that provides current through the current limiting resistor 860 to the diode of the optical isolator 820. When the diode of the optical isolator 820 receives current it in turn causes the transistor of the optical isolator 820 to conduct driving collector terminal, pin 5 of the optical isolator 820 to ground. When the collector terminal, pin 5, of the optical isolator 820 is driven to ground, transistor 840 is immediately cut off which in turn removes the drive voltage from pins 5 and 6 of the timer 825. With the interruption of the drive voltage to the pins 5 and 6 of the door motor timer 825 the output voltage on pin 7 is driven low. When the output voltage on pin 7 of the door motor timer 825 is driven low the drive transistor 845 is turned off which in turn, through the threshold diode 850, permits the Triac 855 to turn off. At this point the further rotation of the guard motor 110 is interrupted and the tray 70 stops moving in its closed position.

If for some reason the vending machine 10 ceased to operate properly, and the motor 110 did not return to its initial position, the door motor timer 825 which is set for a seven to eight second time out period, would, at the end of that seven or eight seconds, exhibit a low voltage on the output pin 7 once again. This low voltage would in turn cease driving the output drive transistor 845. As a result, even if the guard door motor 110 has not properly returned to its initial position, the door motor timer 825 only permits power to be applied thereto for at most a seven or eight second interval before turning off. If a product were to be jammed between the guard door 75 and front right angle bracket 390 it is possible that the guard door motor 110 could not close the door 75 properly thus requiring the time-out of the door motor timer 825 in order to remove drive current from the guard door motor 110. In this instance the springs 415 associated with the tray 70 should close the guard door 75 completely once the obstruction has been removed.

The switch 215 is closed when the product access door 65 is closed. The switch 215 is shown on the motor control circuit 620 as being connected between the output of the switch 810 and line 655, an input to the coin mechanism 20. If the guard motor 110 is in its original position, as indicated by the switch 810 being closed, and if no vending motors have been rotated resulting in 24 volts AC being applied to line 650, the same 24 volts AC will also be applied to the output line 655 through the switch 215 provided that the product access door 65 is closed. The output line 655 is connected to the enable line of the coin mechanism 20. With the product access door 65 closed and 24 volts AC being applied to the enable line of the coin mechanism 20, the coin mechanism 20 will accept coins to permit a coin credit to be generated. If 24 volts AC is not applied to the line 655, the coins will not be accepted by the coin mechanism 20 but will be returned through the coin return chute. Thus, no coins will be accepted if the product access door 65 is being held open for any reason. As described above, once the coin credit signal appears on the line 640, the product access door 65 will be locked closed until the tray 70 has returned to its front-most blocking position.

The capacitor 890 couples a down-going signal from the transistor 845 to the solenoid control circuit 610 in a maintenance situation where one of the vend motors, such as the motor 40, has been rotated without a coin box credit signal having been established on the line 640. The down-going signal triggers the solenoid timer 695 thereby unlocking the tray 70 so that the motor 110 is free to retract it.

The coin box 20 is a standard device such as the model S75 manufactured by Coin Acceptors of St. Louis. The vending modules, such as the modules 30, 35, are standard modules of a type made by Polyvend Inc. The selector switch matrix 20 is a switch matrix manufactured by Oak Industries, Inc. The guard door motor 110 is a standard motor manufactured by General Industries of Eleria, Ohio. The electronic elements in the circuitry of FIG. 7 are either all shown with values or with a specification number.

While those skilled in the art might suggest various modifications and changes it will be understood that I wish to incorporate within the claims of the patent warranted hereon all such modifications and changes as reasonably come within my contribution to the art.

I claim as my invention:

1. In a vending machine having a product dispensing mechanism an improvement comprising:

means for collecting products improperly removed from the product dispensing mechanism, including a slidably mounted, shaped chute with an open lower region which deflects improperly removed products toward said open lower region;

means for storing the collected products and adapted to receive the collected products from said open lower region of said chute when said chute is in a selected position.

2. The vending machine according to claim 1, including further:

control means operable to actuate said chute at the start of each vend cycle so as to store the collected products prior to dispensing a legitimately selected product.

3. In a vending machine having a product dispensing mechanism operable to deliver a selected product to a product delivery area, an improvement comprising:

means for collecting, including a slidable product collection chute located between the product dispensing mechanism and the product delivery area, said chute is adapted to collect products improperly removed from the dispensing mechanism;

a storage region adapted to receive the collected products from said chute;

means for control;

said means for control is adapted to slidably retract said chute at a selected time to store the products collected by said chute in said storage region thereby preventing their being stolen.

4. In a vending machine having a vending mechanism, a product delivery area and a product access door adjacent the product delivery area, an anti-theft improvement comprising:

a shaped product collection chute mounted in a blocking position between the vending mechanism and the product delivery area blocking access to the vending mechanism;

a means for controllably retracting said shaped chute from said blocking position;

said chute having a means for guiding products removed from the vending mechanism, when said chute is in said blocking position, toward a selected region of said chute;

a normally closed storage area, located adjacent said chute;

said means for retracting including means for sensing a validly selected product, and thereupon being operable to retract said chute depositing products collected on said selected region into said storage area, and allowing delivery of the selected product to the product delivery area, and subsequently returning said chute to said blocking position thereby improving the security of the vending machine.

5. The improved vending machine according to claim 4 wherein:

said means for guiding comprises:

a shaped panel oriented so as to guide the products removed from the vending mechanism toward said selected region of said chute.

6. The improved vending machine according to claim 4 having further;

a means for locking connected to said means for retracting, operative to lock said means for retracting and said chute in said blocking position, except when said means for retracting retracts said chute to store the previously collected products and to allow delivery of the selected product to the product delivery area.

7. The improved vending machine according to claim 6 wherein:

said means for locking comprises a spring-biased, solenoid-actuated lever arm which locks the product access door closed except when said means for retracting is locked closed.

8. The improved vending machine according to claim 6, including further;

electrical means for control connected to said means for retracting and said means for locking;

said electrical means for control including: means to unlock said means for locking; means to enable said means for retracting to retract said chute; means to enable said means for retracting to return said chute to said blocking position; means to relock said means for locking with said chute in said blocking position.

9. A method of securely dispensing a single, selected, product from a product dispensing mechanism in a vending machine comprising the steps of:

sensing a valid product selection;

collecting any products previously improperly removed from the product dispensing mechanism;

moving the collected products to a normally closed storage area while simultaneously delivering the selected product to a manually accessible region.

10. An anti-theft module insertable into a selected region of a vending machine having a product dispensing mechanism, the anti-theft module comprising:

shaped means for product collection, slidably movable to a limited extent from a first position, in a first direction;

means for control including, means for sensing a valid product selection;

means for slidably moving said shaped means for product collection in said first direction, thereby depositing any products improperly removed from the dispensing mechanism into a selected region of the vending machine, said means for moving including means for slidably returning said shaped means for product collection to said first position;

a product access region, adjacent said shaped means for product collection when said shaped means is in said first position, adapted to receive the validly selected product from the product dispensing mechanism when said shaped means has been slidably moved in said first direction from said first position.

11. An anti-theft module insertable into a selected region of a vending machine having a product dispensing mechanism, the anti-theft module comprising:

a shaped means for product collection, movable to a limited extent from a first position, in a first direction;

a means for control including, means for sensing a valid product selection;

means for moving said shaped means for product collection in said first direction, thereby depositing any products improperly removed from the dispensing mechanism into a selected region of the vending machine, said means for moving including means for returning said shaped means for product collection to said first position;

a product access region, adjacent said shaped means for product collection when said shaped means is in said first position, adapted to receive the validly selected product from the product dispensing mechanism when said shaped means has been moved in said first direction from said first position, said shaped means for product collection comprises:

a downwardly oriented product collection chute mounted on a means for sliding with said first direction of motion being substantially horizontal.

12. An anti-theft module insertable into a selected region of a vending machine having a product dispensing mechanism, the anti-theft module comprising:

a shaped means for product collection, movable to a limited extent from a first position, in a first direction;

a means for control including, means for sensing a valid product selection;

means for moving said shaped means for product collection in said first direction, thereby depositing any products improperly removed from the dispensing mechanism into a selected region of the vending machine, said means for moving including means for returning said shaped means for product collection to said first position;

a product access region, adjacent said shaped means for product collection when said shaped means is in said first position, adapted to receive the validly selected product from the product dispensing mechanism when said shaped means has been moved in said first direction from said first position, a movable product access door adjacent said product access region;

means for locking, actuated by said means for control, to alternately lock said shaped means for product collection in said first position or said product access door thereby blocking access to said product access region.

13. A method of improving the security of vending machines having a product dispensing mechanism comprising the steps of:

collecting all products improperly removed from the product dispensing mechanism prior to a product being validly selected;

moving all such collected products to a storage region simultaneously while releasing the validly selected product to a customer access region.

14. A method of improving the security of vending machines having a product dispensing mechanism comprising the steps of:

collecting all products improperly removed from the product dispensing mechanism into a product collection chute;

sensing a valid product selection;

moving the chute a selected distance in a first direction;

storing the collected products in a storage area while permitting the selected product to be released to a product delivery area;

returning the product collection chute to its initial position.

15. An anti-theft module insertable into a vending machine with a product selection and release mechanism, said module comprising:

means for collecting improperly removed products;

means for moving all collected products to a closed region after a product has been selected and simultaneously with the release of the selected product from the release mechanism.

16. An anti-theft module insertable into a vending machine, comprising:

means for collecting improperly removed products;

means for storing all collected products in a closed region at the start of each vend cycle;

said means for collecting includes means to dispense a validly selected product; and said means for collecting includes a slidably mounted chute movable from a first position to a second position with all improperly removed products being deposited in said means for storing essentially while said chute is in said second position.

17. In an anti-theft module suitable for being inserted into a vending machine between an operator accessible product delivery area and a product release mechanism designed to release one selected product at a time, an improvement comprising:

means for collecting products improperly removed from the product release mechanism, means for sensing a valid product selection and for actuating said means for collection, said means for collection is adapted to move from a collecting position to, deposit all products improperly removed from the product release mechanism into a storage region not accessible to the operator and to permit the validly selected product to move from the product release mechanism to the operator accessible product delivery area;

said means for collecting includes further means adapted to immediately return said means for collecting to the collecting position once the validly selected product has entered the product delivery area.

18. In an anti-theft module suitable for being inserted into a vending machine between an operator accessible product delivery area and a product release mechanism designed to release one selected product at a time, an improvement comprising:

means for collecting products improperly removed from the product release mechanism, means for sensing a valid product selection and for actuating said means for collection to, deposite all products improperly removed from the product release mechanism into a storage region not accessible to the operator and to permit the validly selected product to move from the product release mechanism to the operator accessible product delivery area; wherein said means for collecting includes:

a slidable shaped chute with an open lower region, and wherein said means for sensing includes:

electrical means for control connected to means for moving to move said chute from a first position to a second position whereat all products improperly removed from the product release mechanism fall through said open lower region of said chute into said storage region while permitting the validly selected product to move from the product release mechanism to the operator accessible product delivery area and to move said chute back to said first position whereat all products improperly removed from the product release mechanism fall onto said chute.

19. The anti-theft module according to claim 18 including further:

a movable product access door affixed adjacent said product delivery area and associated means for locking adapted to lock said door closed while said chute is moving and to inhibit movement of said chute unless said door is closed.

* * * * *